US011506010B1

(12) United States Patent
Harris et al.

(10) Patent No.: US 11,506,010 B1
(45) Date of Patent: Nov. 22, 2022

(54) HIGH EXPANSION WEDGE

(71) Applicants: Robert Harris, Anchorage, AK (US); Carl Diller, Anchorage, AK (US); Candice English, Anchorage, AK (US); John Milne, Anchorage, AK (US)

(72) Inventors: Robert Harris, Anchorage, AK (US); Carl Diller, Anchorage, AK (US); Candice English, Anchorage, AK (US); John Milne, Anchorage, AK (US)

( * ) Notice: Subject to any disclaimer, the term of this patent is extended or adjusted under 35 U.S.C. 154(b) by 176 days.

(21) Appl. No.: 16/830,845

(22) Filed: Mar. 26, 2020

(51) Int. Cl.
*E21B 29/06* (2006.01)
*E21B 23/01* (2006.01)

(52) U.S. Cl.
CPC ..... *E21B 29/06* (2013.01); *E21B 23/01* (2013.01)

(58) Field of Classification Search
CPC ..... E21B 29/06; E21B 23/01
See application file for complete search history.

(56) References Cited

U.S. PATENT DOCUMENTS 5,222,554 A * 6/1993 Blount ..... E21B 23/01 166/117.6
5,494,111 A * 2/1996 Davis ..... E21B 23/01 166/382
6,167,961 B1 * 1/2001 Pollard ..... E21B 7/061 160/298
6,899,173 B2 * 5/2005 Harmon ..... E21B 7/061 166/117.5
2003/0070801 A1 * 4/2003 Harmon ..... E21B 7/061 166/117.5
2007/0034370 A1 * 2/2007 Moyes ..... E21B 17/1021 166/208
2009/0223659 A1 * 9/2009 Hill ..... E21B 23/01 166/55.1

* cited by examiner

*Primary Examiner* — Steven A MacDonald
(74) *Attorney, Agent, or Firm* — Michael J. Tavella

(57) ABSTRACT

A drilling wedge that has, in addition to a normal connector rod, two wings that extend from the sides of the wedge. These wings are angular members that fill much of the space in the larger casing around the wedge. These wings prevent a milling assembly from sliding past the wedge or from moving off to the side, where an exit through the pipe or casing in the wrong place can occur. Instead, the wings help to keep the milling assembly in the proper position on the tray of the wedge to ensure that the milling assembly reaches the proper exit point in the casing. The wings are retracted when the HEW is deployed through the narrower pipe. Once the HEW is properly positioned, the guide cone is extended and the wings are deployed.

19 Claims, 8 Drawing Sheets

HIGH EXPANSION WEDGE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to expansion wedges for fishing and particularly to high expansion wedges.

2. Description of the Prior Art

For over 20 years the North Slope of Alaska has been working with and continually developing a Coiled Tubing Drilling (CTD) program, resulting in over 800 wells to date being drilled. Back then it was a great innovation, allowing access to oil left behind in the original development due to reservoir faulting. One of the reasons CTD is so successful is because it takes an existing "donor" well that has already had a useful life and uses it again. In each CTD well the donor well must be exited to access the oil that was left behind. That exit involves cutting a window in the casing using a whipstock or wedge and mills designed to cut a window in the mother-bore casing. Donor wells come in all shapes and sizes. One of the most challenging exit types historically has been exiting 7" casing when there is a 3-½" tubing string in the well from the surface.

In the prior art, there is no commercially available whipstock system that could successfully mill a 2.80" window off a whipstock set in 7.0" casing/liner. This is due to not being able to properly anchor the whipstock in the 7.0" casing/liner and the mill not being able to stay on the whipstock tray face. The same is true for a 4-½" tubing by 9-⅝" casing/liner. In these scenarios the only available option would be to fill the casing/liner with cement and prepare it for a high side cement pilot hole exit. The pilot hole must be drilled along the high side of the casing/liner to ensure the mills contact the casing as it leaves the whipstock tray face. This type of action can cause many problems such as the milling assembly moving past the whipstock or the milling assembly sliding off to the side of the whipstock and drilling an exit in the wrong location. Moreover, lost production from the mother-bore being cemented off, or in the worst-case scenario losing the wellbore to a poorly executed cement operation is also a potential risk.

Preparing a well for a high side cement pilot hole is a lengthy and costly process. At a minimum it includes two wireline rig ups, and two days of a service coil tubing unit. The wireline runs are to get a static bottom hole pressure, tag top of fill to get plugback total depth, and an optional caliper log of the 7" casing/liner condition. A service coil will then perform a fill clean out if needed, mill any ID restrictions; i.e. nipple profiles less than 2.80" ID. The last step is to place the cement in the 7" casing/liner in an over-balanced method that squeezes off the existing mother-bore perforations and doesn't allow any wellbore fluid/gas invasion that will compromise the integrity of cement.

Many times, this approach has been successful, but this casing exit method has the highest failure rate. For example over 10 years 42 wells were treated using the high side cement pilot hole exit procedure. Out of those 42 wells, 17 of them experienced some form of non-productive time. On average this resulted in 2.3% of a calendar year (8.34 days) lost to trouble time.

The costs associated with well preparation prior to a CTD exit can be 25% of the total overall well cost. By reducing the amount of work required from wireline and service coil to prepare a well for CTD has a side benefit of being able to divert those assets to other wells to increase base production. Not having to drill a cement pilot hole, and other reductions in non-drilling activity conducted by CTD will increase the well's per year achievable, offering additional value to the operation.

BRIEF DESCRIPTION OF THE INVENTION

The instant invention overcomes the difficulties described above. It is wedge that has two extendable wings that extend to fill the gap between the wedge and casing. The wings prevent the mill assembly from wandering off the tray face.

It is an object of this invention to provide a high expansion wedge that eliminates the need for a rig workover and adds relatively little cost to the operation.

It is another object of this invention to provide a high expansion wedge that provides for a faster construction time .

It is yet another object of this invention to provide a high expansion wedge that permits the operator to kick-off lower in the existing completion assuming the formation allows. This enables the well to be sidetracked again from another HEW higher up in the wellbore.

It is yet another object of this invention to provide a high expansion wedge that if the initial HEW fails to anchor properly there is no loss to the existing wellbore, minus the operational rig time cost as compared to a cement pilot hole exit, where, if there are serious enough issues, it could result in the loss of the wellbore.

The HEW is a wedge that has a connecting rod in it that attaches to a setting tool. In addition, it also has two wings that extend from the sides of the HEW. These wings are angular members that fill much of the space in the larger casing around the wedge. These wings prevent the milling assembly from sliding past the wedge or from moving off to the side, where an exit in the wrong place can occur. Instead, the wings help to keep the milling assembly in the proper position on the tray of the wedge to ensure that the milling assembly reaches the proper exit point in the casing.

The wings are retracted when the HEW is deployed through the narrower pipe. Once the HEW is properly positioned, the guide cone is extended and the wings are deployed.

DETAILED DESCRIPTION OF THE INVENTION

Figure 1:
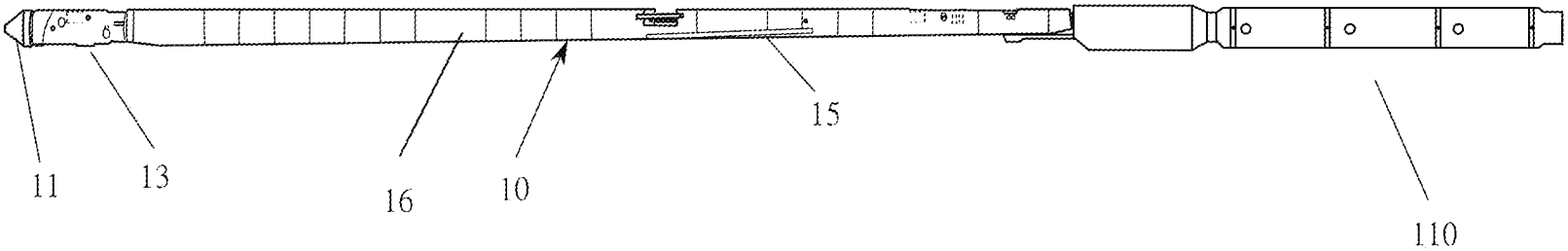
FIG. 1 is a side view of the HEW folded for insertion with a setting tool attached.
Figure 2:
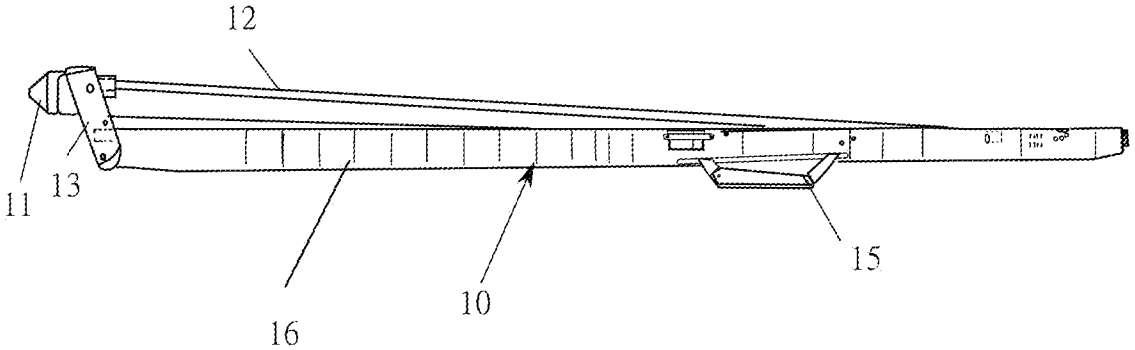
FIG. 2 is a side view of the HEW shown expanded for use. Note no pipe is shown in this figure.

Referring now to the figures and especially FIGS. 1 and 2, the HEW 10 is shown, in FIG. 1, with a setting tool 110 attached, ready for insertion in a casing or liner. The setting tool is a type NS A-1 Setting tool with a 1-½-inch MT Box with weep seat having an 8.2-inch$^2$ piston area and an initiating pressure of 860 psi, or equivalent. The setting tool 110 is used to position the HEW 10 at the desired location in the well. The main body 16 of the tool is called the tray blank. In this figure note the connecting rod 12 and the slip 13 are shown collapsed for installation. Note too the right and left main wings 15 are also stored.

Figure 6:
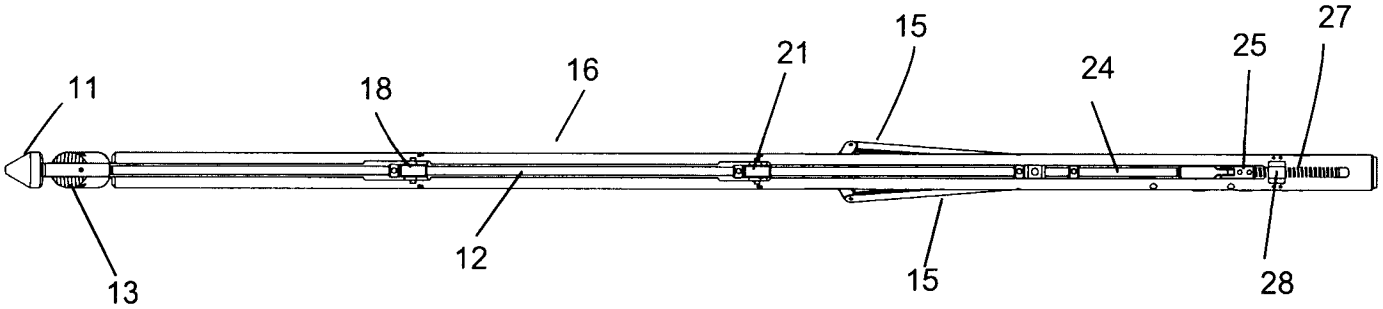
FIG. 6 is a backside view of the HEW shown expanded.

Once in position, the HEW 10 is expanded to lock it in place, and the setting tool 110 is removed and withdrawn. FIG. 2 is a side view of the HEW shown expanded for use. Note no pipe is shown in this figure. To lock the HEW 10 in position, a guide cone 11 is swung out from the setting tool as shown. The guide cone 11 is pivoted out by the connecting rod 12 and the slip 13. Once opened, the HEW is set in the pipe (see FIGS. 7-10 below). At the same time as the guide cone 11 is positioned, the right and left main wings 15 are also expanded. As shown in FIG. 6, these wings can be made with two or three arms (as shown). They can also be solid members as discussed below.

Figure 3:
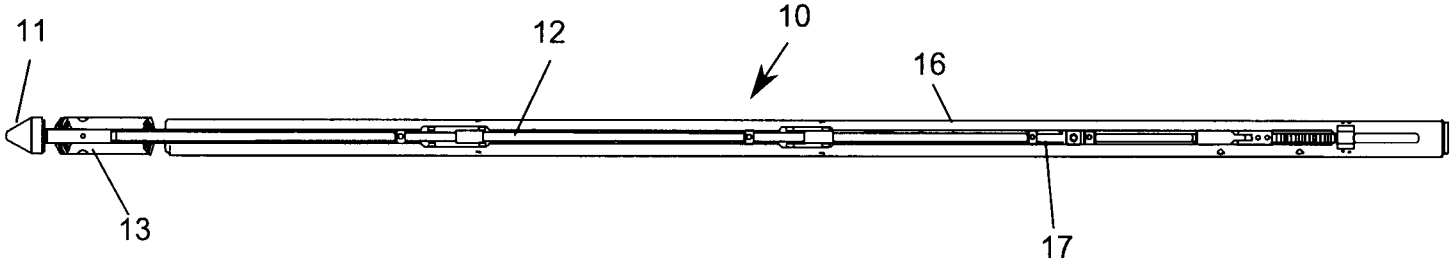
FIG. 3 is a backside view of the HEW shown retracted.

FIG. 3 is a backside view of the HEW shown retracted. Here, the guide cone 11, the connecting rod 12 and the slip 13 are shown. Note the alignment of these components in the retracted state. The main wings 15 are not shown in this view as they are retracted. Note that in this view, the wing actuator 17 is shown.

Figure 4:
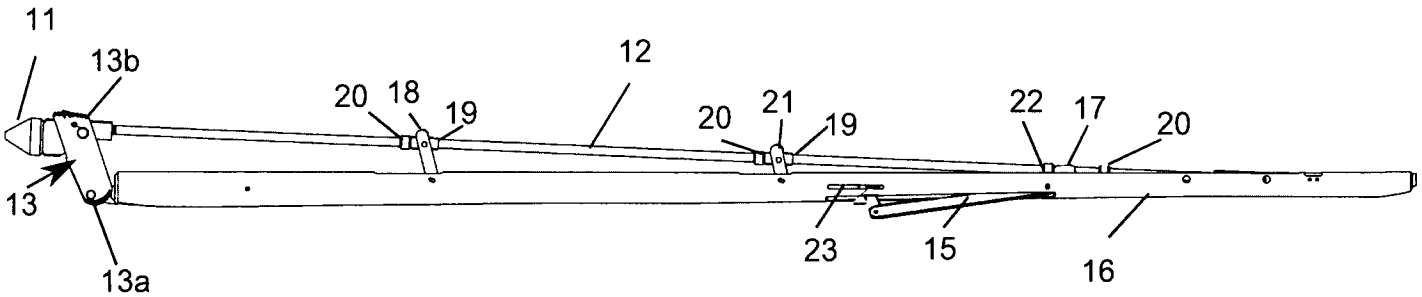
FIG. 4 is a right side view of the HEW with the shown expanded.

FIG. 4 is a right side view of the HEW with the shown expanded. In this view, the guide cone 11, the connecting rod 12 and the slip 13 are shown. The right side main wing 15 is shown expanded. Note here, the main wing has a two-piece constriction. The slip 13 is attached to the tray blank 16 by a pivot pin 13*a*. The slip is attached to the connecting rod by a cam pin 13*b*. Moving up from the slip along the connecting rod 12 there is a a part call a lower foot 18 that ties the lower part of the connecting rod 12 to the tray blank 16. The lower foot is connected to the connecting rod by a trunion connector 19 and a lock spacer 20. Further up along the connecting rod 12 there is an upper foot 21 that is also connected to the connecting rod by a trunion connector 19 and a lock spacer 20. At the top of the connecting rod is another lock spacer 20, a second lock spacer 22, and the wing actuator 17. Also shown in this view is a wing pin 23.

Figure 5:
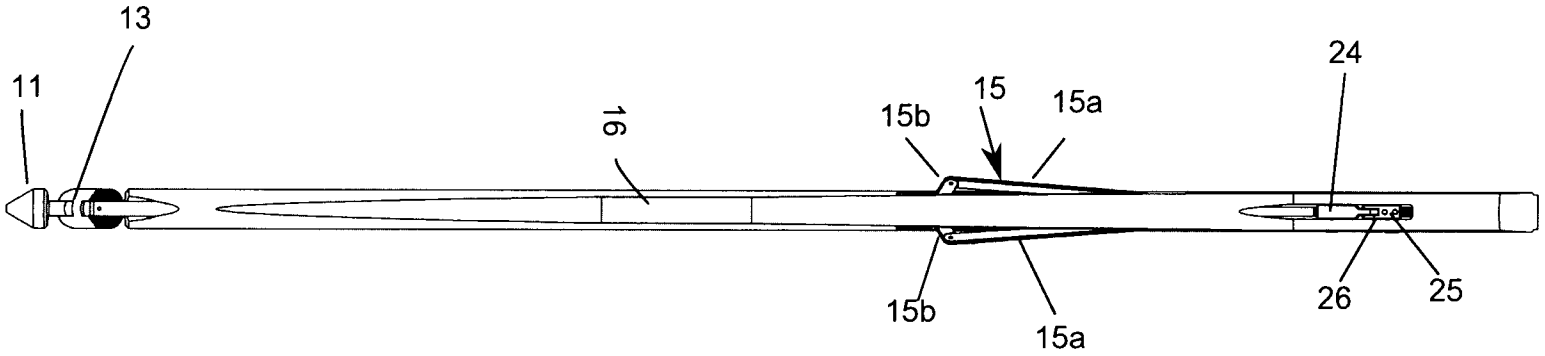
FIG. 5 is a detail view of the tray blank of the HEW shown expanded.

FIG. 5 is a detail view of the tray blank of the HEW shown expanded. In this figure, the tray blank 16 is shown. Note too, the guide cone 11, and the slip 13. Note that the right and left wings 15 are shown deployed. As noted above, these wings are made of two-piece construction having a main wing 15*a* and an upper wing 15*b*. Also as noted above, these wings can be a solid piece or of three-piece construction as well. Also shown in this view are a pivot connector 24, a body lock ring (BLR) mandrel 25 and an alignment pin 26.

FIG. 6 is a backside view of the HEW shown expanded. Here, the tray blank 16 is shown along with the connecting rod 12, the lower foot 18. The main wings 15 are shown expanded. Note here, the main wing here, has a two-piece construction. Also shown in this view is the upper foot 21. At the top is the pivot connector 24. The BLR mandrel 25, as shown, is a square block with two holes 25*a* for shear screws 25*b*. The setting rod adapter hooks are used to attach the setting tool to the device. Once the HEW is in position, the setting tool is pulled upwards to activate the HEW and to retrieve it the setting tool. As the setting tool is pulled up, it pulls BLR 25 up too, which activates the anchor and the wings simultaneously as the connecting rod is pulled. Once the anchor and wings are deployed, there is no more movement in the unit and the shear screws 25*b* break allowing the setting tool to be removed. The BLR 25 holds the energy after the shear screws 25*b* break, which allows the setting tool to be retrieved while the anchor and wings stay locked in place. Note that the body lock ring 25 and the connecting rod is considered to be a means for opening the wings and anchor. The shear screws 25*b* are considered to be a means for releasing the setting tool from the device.

Figure 7:
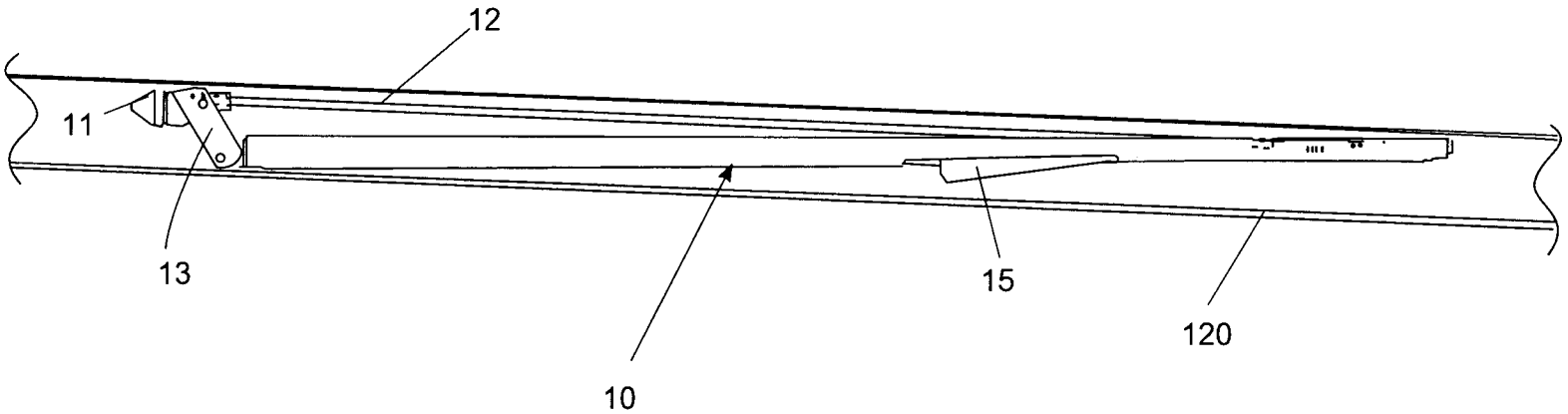
FIG. 7 is a side view of the HEW shown expanded in a pipe.

FIG. 7 is a right side view of the HEW 10 shown expanded in a pipe 120. When expanded, the HEW 10, at its lowest point extends across the width of the pipe 120. Note that the HEW 10 is set at an angle with respect to the pipe, as shown. This angle is used to guide a milling assembly to a point on the side of the pipe 120 to create an exit. As discussed above, the wings 15 expand near the top of the HEW. In that way, the wings 15 act to ensure the milling assembly remains in the proper location. This is discussed in more detail below.

Figure 8:
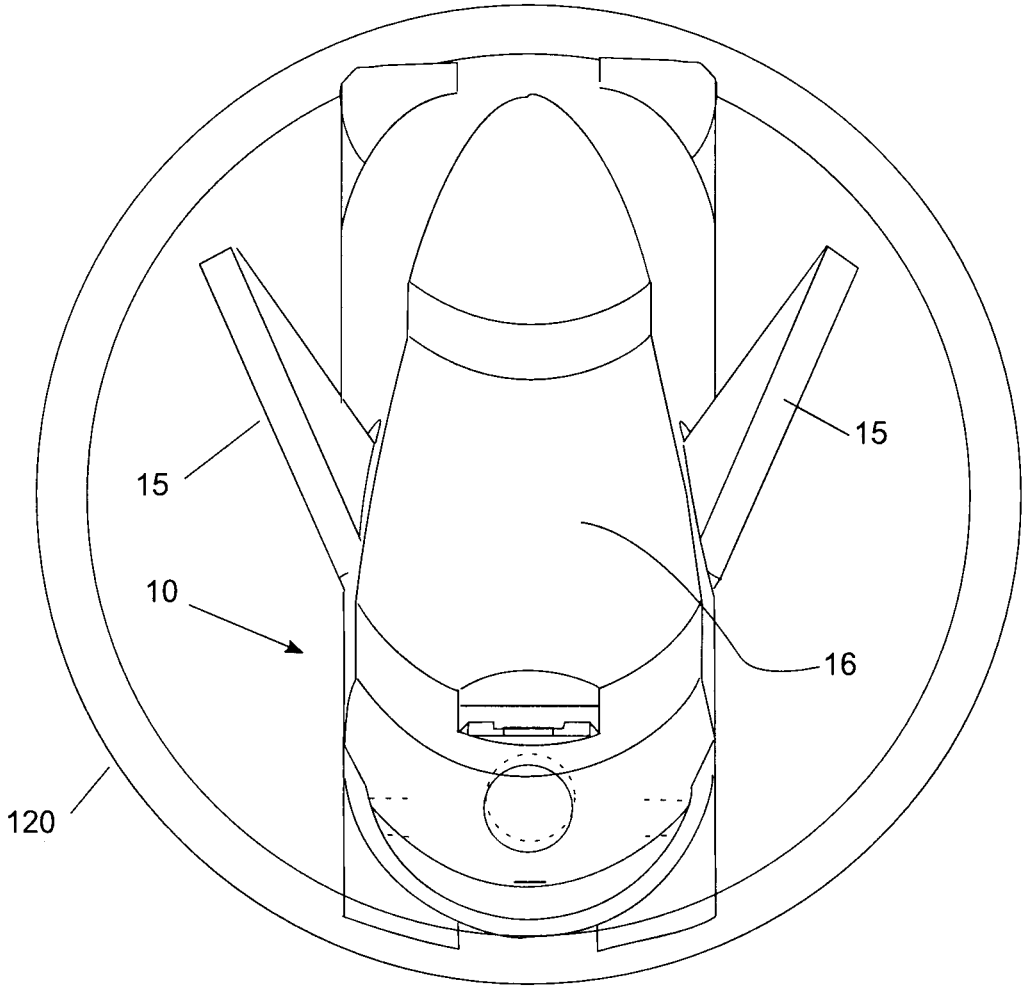
FIG. 8 is a top view of the expanded HEW in a pipe showing the expanded wings.

FIG. 8 is a top down view of the expanded HEW in a pipe showing the expanded wings. In this view, the tray blank 16 of the HEW 10 is shown. Note the position of the wings 15 with respect to the tray blank 16. Note too that the wings here are solid members.

Figure 9:
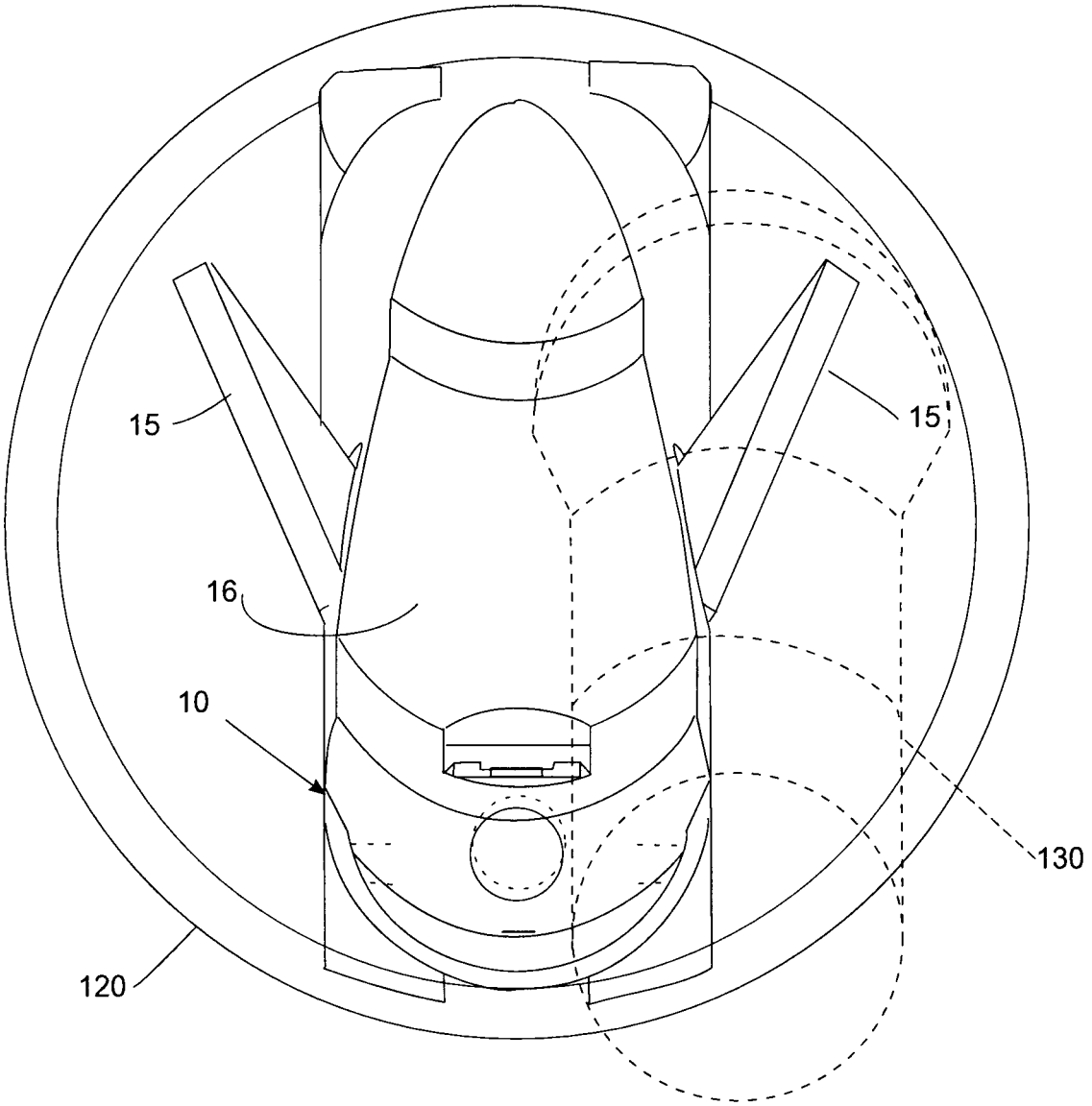
FIG. 9 is top view of the expanded HEW showing a milling assembly and the use of the wings.

FIG. 9 is top view of the expanded HEW showing a milling assembly and the use of the wings. Here, a milling assembly 130 that has slid off the tray blank 16 of the HEW is shown. The milling assembly 130 has been stopped by the wing 15. in this way, the milling assembly 130 cannot slide past the HEW; nor can it angle off prematurely. The milling assembly 130 can be returned to the HEW tray 16 without serious problems.

Figure 10:
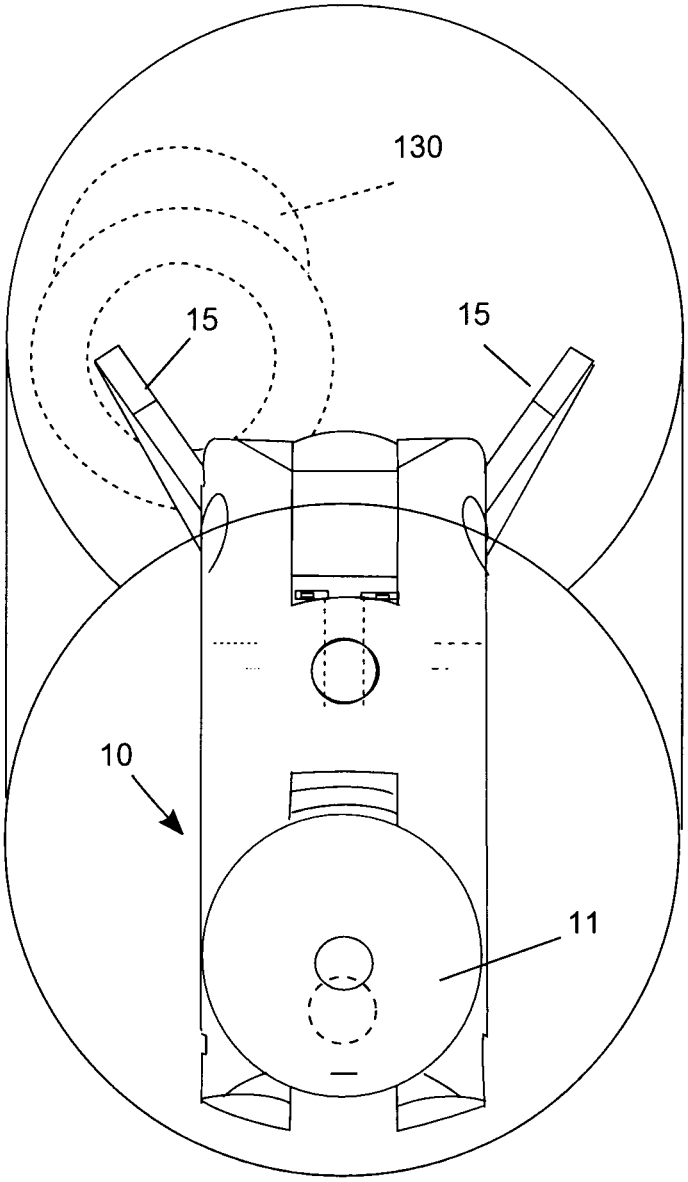
FIG. 10 is a bottom view of the expanded HEW showing a milling assembly and the wings.

FIG. 10 is a bottom view of the expanded HEW showing a milling assembly and the wings. Here, the bottom of the HEW 10 is shown. Note the guide cone 11. Note too, the position of the wings 15. The milling assembly 130 is shown blocked by the wings 15 Once again, the milling assembly can be returned to its proper course without great difficulty.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A high expansion wedge for use in oil well casing comprising:

a tray blank having a top, a bottom, and a center midway between said top and said bottom, said tray blank having a pair of slots formed therein;

the top being on the uphole end of the tray blank;

a pair of extendable wings located between said top and said center portion of said tray blank, positioned inside of said tray blank in a first position and being extended outside of said tray blank in a second position; and a means for opening said pair of extendable wings operably installed in said tray blank and in operable communication with said pair of extendable wings;

wherein the tray blank is configured to form a wedge to guide a milling assembly to an exit point in the casing when the extendable wings are in the second position.

2. The high expansion wedge of claim 1 wherein said means for opening said pair of extendable wing causes said pair of extendable wings to move from said first position to said second position.

3. The high expansion wedge of claim 1 wherein the means for opening said pair of extendable wings includes:

a connecting rod, in operable communication with said pair of extendable wings; and a body lock ring, in operable communication with said connecting rod.

4. The high expansion wedge of claim 3 further comprising:

a slip, hingably attached to said tray blank and said connecting rod; and a guide cone, attached to said slip.

5. The high expansion wedge of claim 1 wherein each of the extendable wings is a solid member.

6. The high expansion wedge of claim 1 wherein each of the extendable wings is a two-piece member.

7. The high expansion wedge of claim 1 wherein each of the extendable wings is a three-piece member.

8. The high expansion wedge of claim 1 further comprising:

a setting tool in operable communication with said means for opening said pair of extendable wings.

9. The high expansion wedge of claim 8 further comprising a means for releasing the setting tool from said means for opening said pair of extendable wings.

10. The high expansion wedge of claim 9 wherein the means for opening said pair of extendable wings includes a body lock ring in operable communication with said setting tool.

11. The high expansion wedge of claim 10 wherein the means for releasing the setting tool from said means for opening said pair of extendable wings comprise at least one shear screw in operable communication with said body lock ring and said setting tool.

12. A wedge for use in oil well casing having a tray blank, having a top, a bottom, and a center midway between said top and said bottom, a connecting rod hingably attached to the tray blank, a slip hingably attached to said tray blank and the connecting rod, and a guide cone attached to said slip wherein the improvement comprises:

a pair of extendable wings located between said top and center of said tray blank, positioned inside of said tray blank in a first position and being extended outside of said tray blank in a second position; the top being on the uphole end of the tray blank; and a means for opening said pair of extendable wings operably installed in said tray blank and in operable communication with said pair of extendable wings;

wherein the tray blank is configured to form a wedge to guide a milling assembly to an exit point in the casing when extendable wings are in the second position.

13. The high expansion wedge of claim 12 wherein each of the extendable wings is a solid member.

14. The high expansion wedge of claim 12 wherein each of the extendable wings is a two-piece member.

15. The high expansion wedge of claim 12 wherein each of the extendable wings is a three-piece member.

16. The high expansion wedge of claim 12 further comprising:

a setting tool in operable communication with said means for opening said pair of extendable wings.

17. The high expansion wedge of claim 16 further comprising a means for releasing the setting tool from said means for opening said pair of extendable wings.

18. The high expansion wedge of claim 17 wherein the means for opening said pair of extendable wings includes a body lock ring in operable communication with said setting tool.

19. The high expansion wedge of claim 18 wherein the means for releasing the setting tool from said means for opening said pair of extendable wings comprise at least one shear screw in operable communication with said body lock ring and said setting tool.

* * * * *